US006747565B2

(12) United States Patent
Mochizuki

(10) Patent No.: US 6,747,565 B2
(45) Date of Patent: Jun. 8, 2004

(54) REMOTE CONTROL SIGNAL RECEPTION DEVICE

(75) Inventor: Kazuo Mochizuki, Tokyo (JP)

(73) Assignee: NEC Viewtechnology, Ltd., Tokyo (JP)

( * ) Notice: Subject to any disclaimer, the term of this patent is extended or adjusted under 35 U.S.C. 154(b) by 203 days.

(21) Appl. No.: 09/737,566

(22) Filed: Dec. 18, 2000

(65) Prior Publication Data

US 2001/0004243 A1 Jun. 21, 2001

(30) Foreign Application Priority Data

Dec. 17, 1999 (JP) ..... 11-358820

(51) Int. Cl.[7] ..... G08C 19/00

(52) U.S. Cl. ..... 340/825.69; 455/103; 459/157; 348/734

(58) Field of Search ..... 340/825.69, 825.72; 359/142, 157; 455/133, 273, 277.1; 348/734

(56) References Cited

U.S. PATENT DOCUMENTS 4,663,768 A * 5/1987 Ryu ..... 375/100
5,402,257 A * 3/1995 Hasselmann et al. ..... 359/144
5,877,747 A * 3/1999 Kitao et al. ..... 345/160

FOREIGN PATENT DOCUMENTS

| | | |
|---|---|---|
| GB | 2 271 872 | 4/1994 |
| JP | U 2-79685 | 6/1990 |
| JP | U 3-2792 | 1/1991 |
| JP | A 4-113799 | 4/1992 |
| JP | A 8-205270 | 8/1996 |

* cited by examiner

*Primary Examiner*—Michael Horabik
*Assistant Examiner*—M Shimizu
(74) *Attorney, Agent, or Firm*—Young & Thompson

(57) ABSTRACT

A remote control signal from a remote controller (2) is received by one of remote control optical reception parts (4*a* to 4*d*), and the respective reception signals are decoded by decoders (11*a* to 11*d*). At this moment, the decoders (11*a* to 11*d*) extract an address code included in the reception signals received by the remote control optical reception parts (4*a* to 4*d*). Based on this address code, an effective-ineffective signal showing effectiveness or ineffectiveness of the decode signal is created. When the effective-ineffective signal shows effectiveness, a decoder selection part (12) adopts a decoder signal of the corresponding decoder.

10 Claims, 4 Drawing Sheets

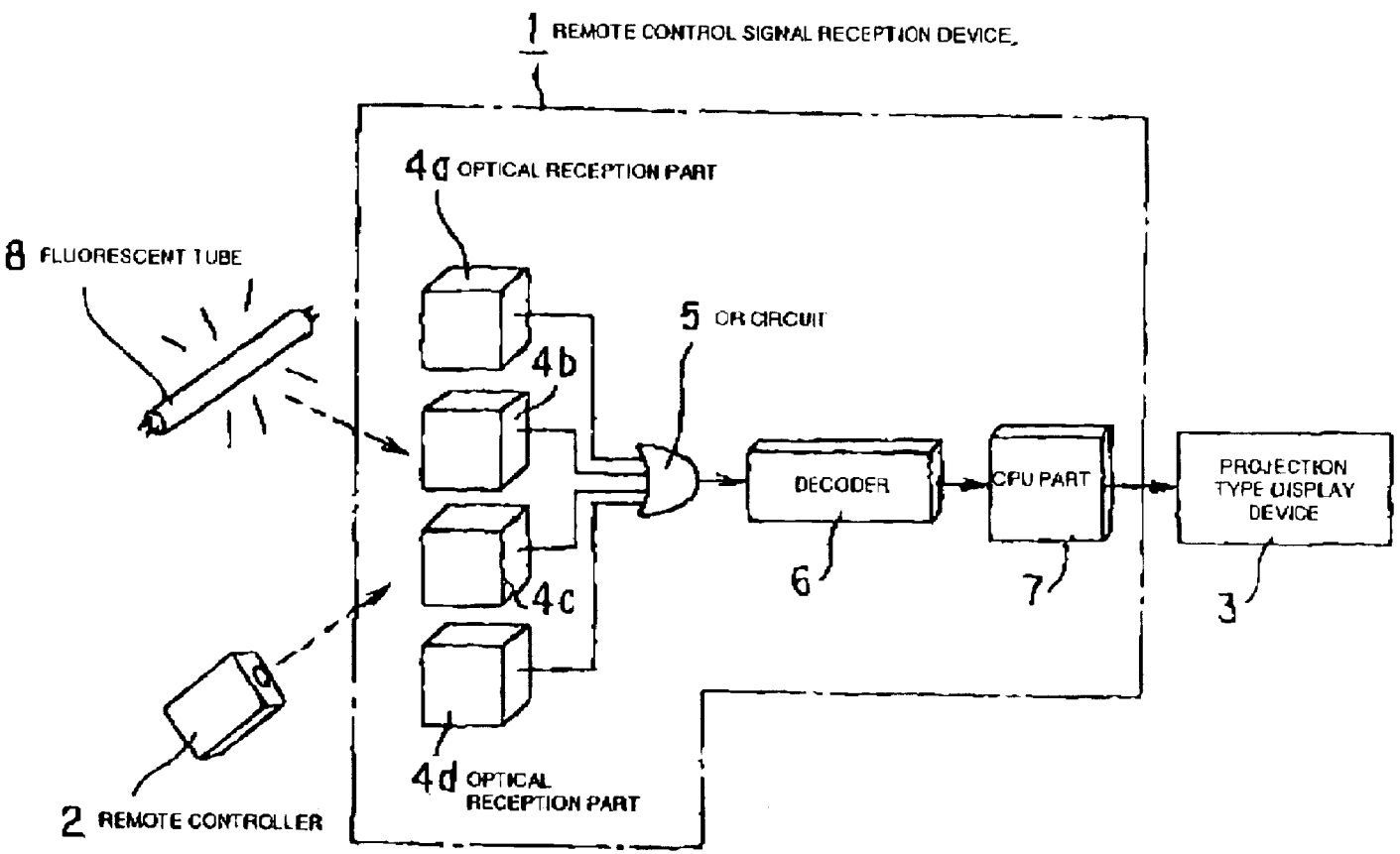
[Fig. 1] PRIOR ART

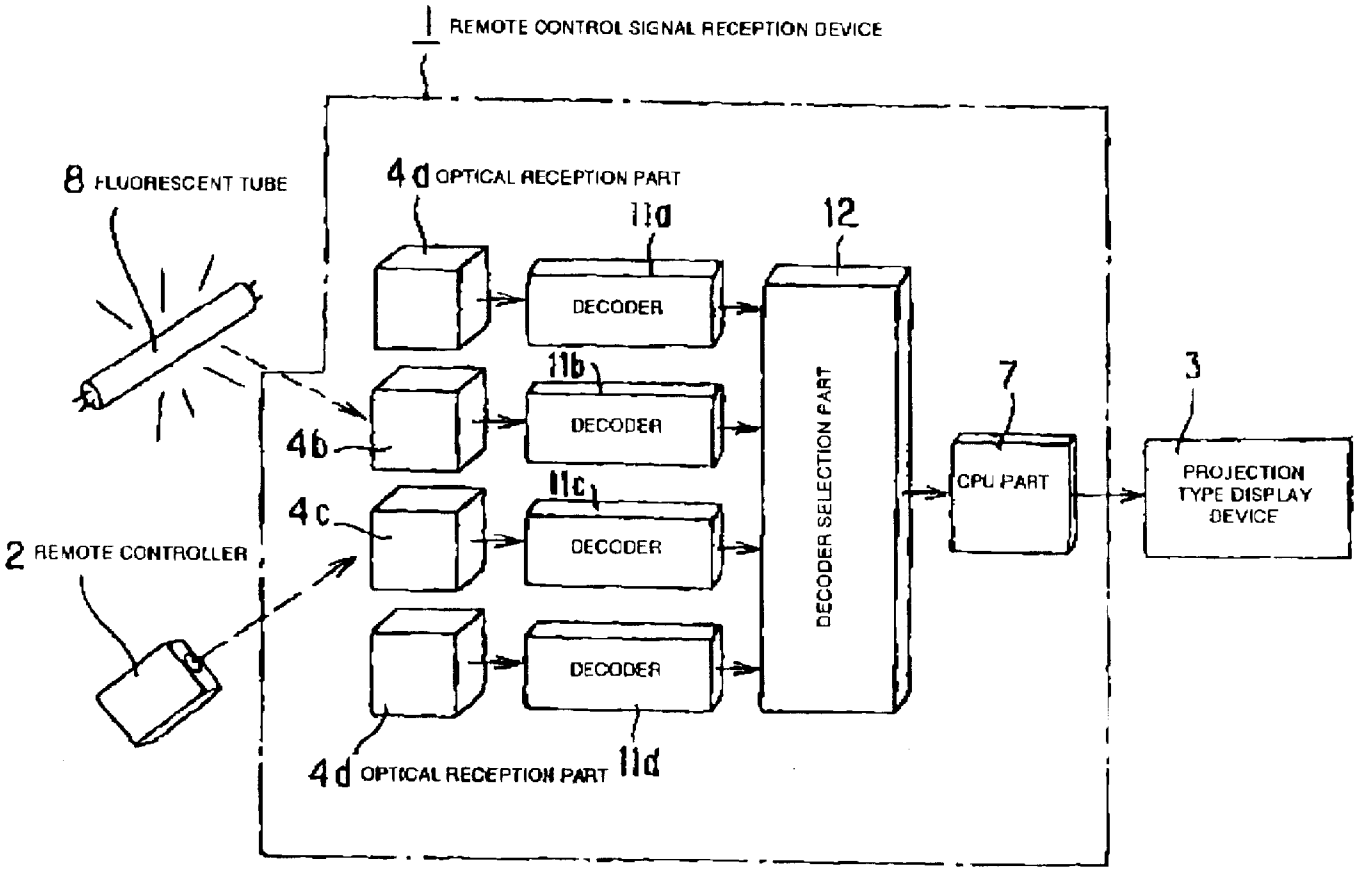
[Fig. 2]

[Fig. 3]
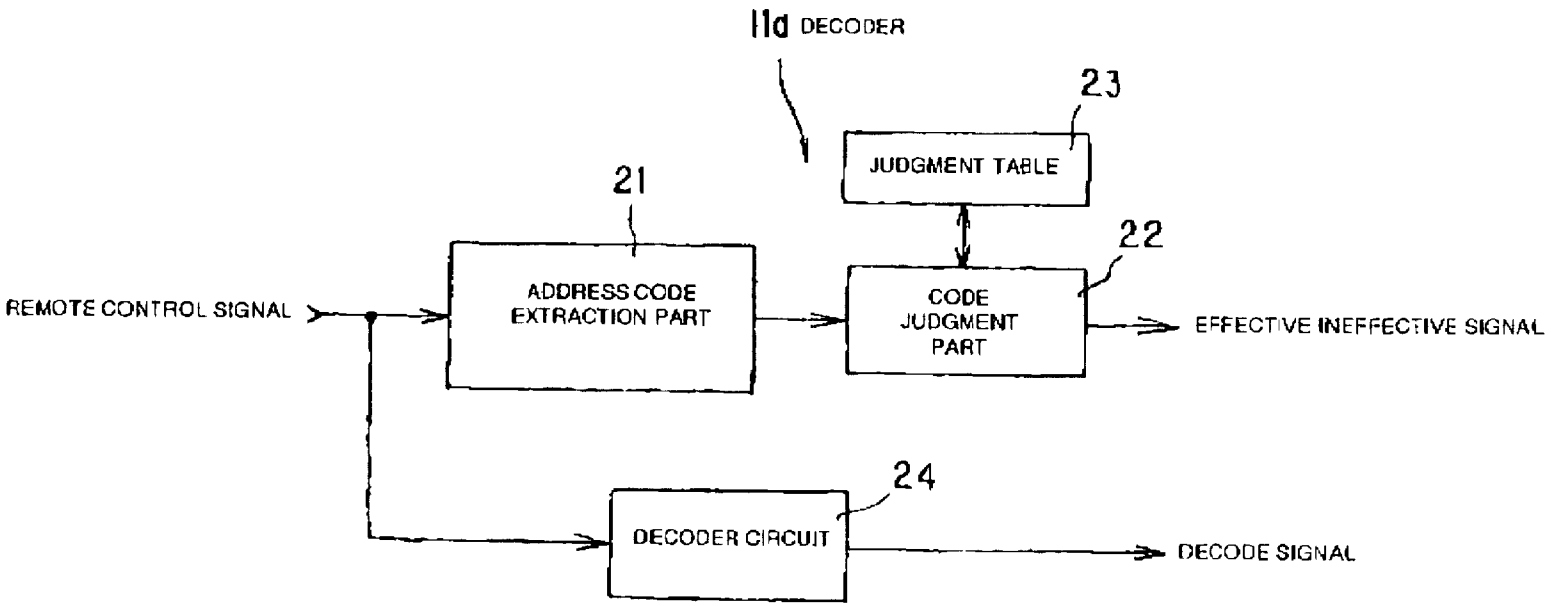

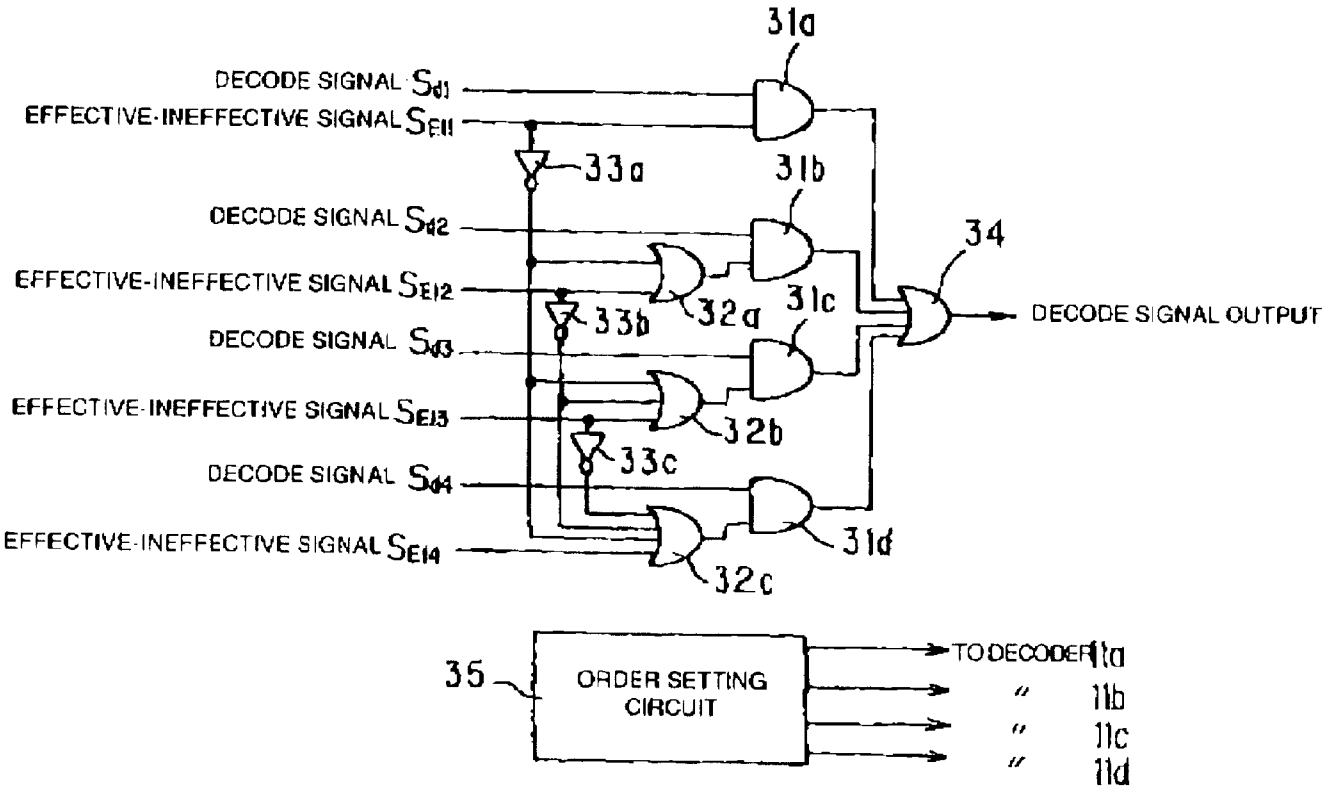
[Fig. 4]

REMOTE CONTROL SIGNAL RECEPTION DEVICE

FIELD OF THE INVENTION

The present invention relates to a remote control signal reception device, and more particularly, relates to a remote control signal reception device in which the infrared ray signal from one remote controller can optically be received by any one of a plurality of signal optical reception parts to avoid the impossibility of the remote control due to noise.

BACKGROUND OF THE INVENTION

In the case of a projection type display device (projector), there are many cases where it is provided in the state the main body part performing projection is hung down from the ceiling of a building such as a hall or it is used in the state of standing at a given height. In the case where the main body is provided at a certain height or it is hung down from the ceiling, the operator (user) performs the operation and control of the apparatus while seeing the picture projected on the screen. Therefore, in many cases, the direction of the view of the operator and the mounting place of the main body part optically receiving the remote control signal do not agree with each other. As means for solving such a problem, there is a method in which a plurality of signal optical reception parts are provided in different optically receiving directions. This configuration will be described below.

FIG. 1 shows a conventional remote control signal reception device.

The remote control signal reception device 1 optically receives a remote control signal by using an infrared ray from a remote controller 2, and decodes this, and according to that result of decoding, it controls a projection type display device 3. The remote control signal reception device 1 comprises a plurality of remote control optical reception parts 4*a*, 4*b*, 4*c*, 4*d* that are reception parts having means for receiving a remote control signal by using infrared light and performing photoelectric conversion, an OR circuit 5 connected to these remote control optical reception parts 4*a* to 4*d*, a decoder 6 connected to this OR circuit 5, a CPU part 7 (Central Processor Unit) for controlling the projection type display device 3 according to the result of decoding of this decoder 6. The remote control optical reception parts 4*a* to 4*d* are arranged so that the remote control signal from the remote controller 2 can be optically received from many directions such as the hack and forth direction, right and left direction, or vertical direction, and they have converting means for performing the photoelectric conversion of the received optical signal and amplifying means for amplifying the electric signal subjected to the photoelectric conversion. From the remote controller 2, the optical signal made by subjecting the electric signal corresponding to the operating contents to the photoelectric conversion and to the optical modulation is transmitted.

In FIG. 1, when the optical signal is transmitted from the remote controller 2, that remote control signal is optically received by one or a plurality of the remote control optical reception parts 4*a* to 4*d*. The output signals of the remote control optical parts 4*a* to 4*d* are subjected to the OR logic by the OR circuit 5, and inputted into the decoder 6. The decoder 6 decodes the remote control signal and outputs the result thereof to the CPU part 7. The CPU part 7 controls the projection type display device 3 according to the result of decoding. Since the output signals from the remote control optical reception parts 4*a* to 4*d* can be composed by the OR circuit 5, one decoder 6 is sufficient.

However, according to the conventional remote control signal reception device, there has been such a problem where in the case where the noise is inputted from one (or a plurality) of remote control optical reception parts 4*a* to 4*d*, even when a normal remote control signal is optically received from another remote control optical reception part, the remote control signal is interfered by the noise, and a normal remote control signal cannot be taken out of the signal composed by the OR circuit 5.

In the case where the optical reception part of the remote control signal reception device is provided at the ceiling, when the mounting place is a public facility, a lot of illuminating apparatus are attached to the ceiling. In the case where it is inevitable to arrange the optical emitting part and the optical reception part of this illuminating apparatus facing to each other, and in the situation where they are adjacent to each other, the light of the illuminating apparatus is optically inputted into the optical reception part at a high level. Since the wavelength of this light is wide, it is sensed by the optical reception part and becomes a noise. Furthermore, in the case of an illuminating apparatus whose operating principle is the discharge phenomenon like the fluorescent tube 8, an electromagnetic wave is generated, and it gives effect on the electronic circuit of the optical reception part. Therefore, in the case where the remote control optical reception part is provided near the fluorescent tube 8, the light or electromagnetic wave from the fluorescent tube 8 is received as a noise by the remote control optical reception part (here, the remote control optical reception part 4*b*) near the fluorescent tube 8. At this moment, if the remote control signal of the remote controller 2 is received by the remote control optical reception part 4*c*, the remote control signal by the remote control optical reception part 4*c* and the noise signal by the remote control optical reception part 4*b* are composed in the OR circuit 5. As a result of this, when the noise signal is large, the remote control signal is affected, and it becomes difficult to decode the remote control signal.

Accordingly, it is an object of the present invention to provide a remote control signal reception device in which it is possible to take out a remote control signal without receiving any effect of the noise even when the reception part receiving the effect of the external noise is provided near the noise source.

SUMMARY OF THE INVENTION

In order to attain the above-described object, according to the present invention, there is provided a remote control signal reception device that receives a remote control signal transmitted from a remote controller by one of a plurality of reception parts and controls an apparatus such as a projection type display device on the basis of the result obtained by decoding this received remote control signal, comprising a plurality of decoders connected to one corresponding reception part of said plurality of reception parts and creating a decode signal by decoding the above-described remote control signal and creating an effective signal showing the effectiveness of the above-described remote control signal on the basis of the identification information included in the above-described remote control signal, and a decider selection part for outputting the above-described decode signal on the basis of the input of the above-described effective signal when the above-described decode signal is inputted.

According to this configuration, the remote control signal and noise components are received in a plurality of reception parts. In a decoder connected to each reception part, the identification information in the received remote control signal is extracted, and when this identification information corresponds to the remote control apparatus, an effective signal showing the effectiveness of the received remote control signal is outputted. Based on this effective signal, the decoder selection part adopts only the decode signal of the decoder outputting the effective signal, As a result of this, even when the noise components are inputted into one of a plurality of reception parts, the original operation can be performed if at least one normal remote control signal is received. Accordingly, it becomes possible to surely control a remote control apparatus from a remote place.

BRIEF DESCRIPTION OF THE DRAWINGS

FIG. 1. is a schematic diagram showing a conventional remote control signal reception device;

FIG. 2 is a schematic diagram showing a remote control signal reception device of the present invention;

FIG. 3 is a block diagram showing the detailed configuration of a decoder of FIG. 2; and FIG. 4 is a block diagram showing the detailed configuration of a decoder selection part of FIG. 2.

DESCRIPTION OF THE PREFERRED EMBODIMENTS

The preferred embodiment of the present invention will be described below on the basis of drawings.

FIG. 2 shows a remote control signal reception device according to the present invention. In the figure, the same reference numerals are used for the same parts as those in FIG. 1, and therefore, the repeated description will be omitted below.

The remote control signal reception device 10 in the present embodiment comprises remote control optical reception parts 4*a* to 4*d*, decoders 11*a*, 11*b*, 11*c*, 11*d* connected to the respective remote control optical parts 4*a* to 4*d*, a decoder selection part 12 for selecting only an effective decoder on the basis of the output contents of these decoders 11*a* to 11*d*, and a CPU part 7 to be operated by the output signal of this decoder selection part 12.

From the remote controller 2, a remote control signal including a remote control code and an address code as the apparatus identification information is transmitted. The remote control code is operating information corresponding to the operating contents of each button of the remote controller 2, and the address code is apparatus identification information for specifying the apparatus to be controlled (here, a projection type display device 3).

Here, it is supposed that near the remote control optical reception part 4*b*, a fluorescent tube 8 as an illuminating apparatus is provided, and the remote control optical reception part 4*c* optically receives the remote control signal from the remote controller 2. Among the output signals from the remote control optical reception parts 4*a* to 4*d*, the remote control codes are decoded by the decoders 11*a* to 11*d*, respectively. At this moment, from the remote control optical reception part 4*b*, noise components are outputted as the signal, and the remote control signal from the remote controller 2 is subjected to the photoelectric conversion and outputted from the remote control optical reception part 4*c*. From other remote control optical reception parts 4*a*, 4*d*, no signal is outputted.

In the output signals from the decoder 11*a* to 11*d*, as described later, a decode signal and an effective-ineffective signal (effective signal described in [0008] and [0009] corresponds, to the effective side in the effective-ineffective signal) showing the effectiveness or ineffectiveness of the above-described decode signal are outputted. Here, from the decoders 11*a*, 11*b*, 11*d*. an ineffective signal is outputted, and an effective signal is outputted only from the decoder 11*c*. Therefore, the decoder selection part 12 selects the decoder 11*c* having an effective signal, and transfers the decode signal of the decoder 11*c* to the CPU part 7.

FIG. 3 shows the detailed configuration of the decoders 11*a* to 11*d* shown in FIG. 2. Since the decoders 11*a* to 11*d* have the same configuration, here, only the decoder 11*a* is shown in the figure and described. The decoder 11*a* comprises an address code extraction part 21 for extracting an address code from the remote control signal outputted from the remote control optical reception part 4*a*, a decode judgment part 22 for creating an effective-ineffective signal $S_{EI}$ on the basis of the address code from this address code extraction part 21, a judgment table 23 where an address code used for the judgment of this decode judgment part 22 is stored, and a decoder circuit 24 for creating a decode signal $S_d$ from the remote control signal inputted from the remote control optical reception part 4*a*.

In the address code extraction part 21, an address code for specifying the projection type display device 3 is extracted from the remote control signals outputted from the remote control optical reception parts 4*a* to 4*d*. The judgment table 23 judges whether the extracted address code agrees with the address code previously registered in the judgment table 23 or not. When the address code extracted by the address code extraction part 21 exists in the judgment table 23, the decode judgment part 22 sets the effective-ineffective signal $S_{EI}$ at "1" (effective), and when the address code does not exist in the judgment table 23, it sets the effective-ineffective signal $S_{EI}$ at "0" (ineffective). On the other hand, in the decoder circuit 24, the remote control code from the remote control optical reception part 4*a* is decoded regardless of the contents of the effective-ineffective signal $S_{EI}$. That is, the operating contents of the operated (pressed) key among the keys provided in the remote controller 2 are outputted as the decode signal.

FIG. 4 shows the detailed configuration of the decoder selection part 12.

The decoder selection part 12 comprises AND circuits 31*a*, 31*b*, 31*c*, 31*d*, OR circuits 32*a*, 32*b*, 32*c*, 32*d*, inverters 33*a*, 33*b*, 33*c*, an OR circuit 34 to be the output circuit, and an order setting circuit 35.

To the AND circuit 31*a*, the decode signal $S_{d1}$ of the decoder 11*a* and the effective-ineffective signal $S_{EI}$ are inputted, and to the AND circuit 31*b*, the decode signal $S_{d2}$ of the decoder 11*b* and the output signal of the OR circuit 32*a* of the input 2 are inputted and to the AND circuit 31*c*, the decode signal $S_{d3}$ of the decoder 11*c* and the output signal of the OR circuit 32*b* of the input 3 are inputted, and to the AND circuit 31*d*, the decode signal $S_{d4}$ of the decoder 11*d* and the output signal of the OR circuit 32*c* of the input 4 are inputted. The output signal of each of the AND circuits 31*a* to 31*d* is inputted in the OR circuit 34, and the result obtained by subjecting it to the OR logic is outputted as the decode signal.

In the OR circuit 32*a*, a signal made by reversing the effective-ineffective signal $S_{EI1}$ in the inverter 33*a* is inputted to one input terminal, and an effective-ineffective signal $S_{EI2}$ from the decoder 11*b* is inputted in the other input terminal. In the OR circuit 32*b*, an output signal of the inverter 33*a* is inputted in a first input terminal, and an output signal of the inverter 33*b* is inputted in a second terminal, and an effective-ineffective signal $S_{EI3}$ is inputted in a third terminal. Furthermore, in the OR circuit 32*c*, an output signal of the inverter 33*c* is inputted in a first input terminal, and an output signal of the inverter 33*b* is inputted in a second terminal, and an output signal of the inverter 33*a* is inputted in a third terminal, and an effective-ineffective signal $S_{EI4}$ is inputted in a fourth terminal, In FIG. 4, if the remote control optical reception part 4*c* receives a remote control signal from the remote controller 2, the remote control signal by the infrared ray from the remote controller 2 is subjected to the photoelectric conversion, and is converted into an electric signal. In this electric signal, a remote control code and an address code that are not decoded are included. By the decoder circuit 24 of the decoder 11*c* with the configuration shown in FIG. 3, the remote control code is decoded, and a decode signal $S_{d3}$ is created, and inputted in the AND circuit 31*c*. Furthermore, by the address code extraction part 21, decode judgment part 22, and judgment table 23, an effective-ineffective signal $S_{EI3}$ expressing "1" (effective) is created, and inputted in the OR circuit 32*b*. At this moment, if all the decoders 11*a*, 11*b*, 11*d* output the ineffective-ineffective signals $S_{EI1}$, $S_{EI2}$, $S_{EI4}$ expressing the ineffectiveness ("0"), the logical condition is not established in all the AND circuits 31*a*, 31*b*, 31*d*, and therefore, no output signal is created.

In this state, signals of "1" are outputted from the inverters 33*a*, 33*b*. Accordingly, in the OR circuit 32*b*, a signal of "1" is inputted into all three input terminals, and the output signal is "1". This signal is inputted in the AND circuit 31*c* together with the effective-ineffective signal $S_{EI3}$. Accordingly, from the AND circuit 31*c*, a signal of level "1" is outputted. The effective-ineffective signal $S_{EI3}$ remains at "1", but the decode signal $S_{d3}$ is a digital signal corresponding to the operating contents of the remote controller 2, and it is outputted to the CPU part 7 through the OR circuit 34.

Herein, in the case where effective signals are simultaneously outputted from the decoders 11*a* to 11*d*, according to the configuration in FIG. 4, a plurality of data are simultaneously outputted from the OR circuit 34. Therefore, by the order setting circuit 35, an order is previously set to the decoders 11*a* to 11*d*, and according to this order, the effective-ineffective signals $S_{EI1}$ to $S_{EI4}$ are outputted by turns Next, the case where the remote control optical reception part 4*b* receives an electromagnetic wave (radiating noise) of the fluorescent tube 8 will be described. The remote control optical reception part 4*b* performs the photoelectric conversion corresponding to the level of the radiating noise from the fluorescent tube 8, and converts the signal into an electric signal (hereafter, referred to as a noise signal). The noise signal is inputted in the address code extraction part 21 of the decoder 11*b*, but it has no address code, and therefore, the effective-ineffective signal $S_{EI2}$ is set at "0". Furthermore, no remote control code is also included in the reception signal, and therefore, the decoder circuit 24 does not create a normal decode signal, but it may decode the noise signal by mistake and make that be the decode signal.

Since the effective-ineffective signal $S_{EI2}$ of the decoder 11*b* is "0" and the output of the inverter 33*a* is "0", the OR logic is not established in the OR circuit 32*a*, and no output signal is created. Therefore, in the AND circuit 31*b*, the AND logic is not established even if a decode signal 2 due to the decoding in error or the like exists, and no output signal is created. Accordingly, the decoder selection part 12 can make the output of the decoder 11*b* ineffective.

As mentioned above, according to the embodiment of the present invention, a circuit for extracting only an effective remote control signal is provided to a plurality of remote control optical reception parts 4*a* to 4*d*, and consequently, even in the case where a noise is inputted in one of the remote control optical reception parts, the decoding of the remote control signal can normally be performed if a normal remote control signal is optically received from another remote control optical reception part.

Consequently, for example, even when the projection type display device or the like is provided near an illuminating apparatus to be a noise source, the effect of the noise is not received, and the remote control signal can surely be taken out.

Herein, in the above-described embodiment, the description has been given by limiting the illuminating apparatus to the fluorescent tube, but the noise source is not limited to the fluorescent tube, all the illuminating apparatus including the light of the wavelength area to be detected by the optical reception part is the object. Especially, an illuminating apparatus whose light emitting wavelength extends to the infrared ray area has greatly an influence.

Furthermore, in the above-described embodiment, the remote controller and the remote control optical reception part use an infrared ray, but the present invention is not limited to the infrared ray communication, but for example, it may be a remote control system using a radio wave or a supersonic wave in the air. In this case, the effect of the noise is an effect by something other than the light.

Furthermore, as an apparatus to be controlled, a projection type display device (projector) has been described, but it is not limited to this, but the present invention is applicable for all the apparatus having a plurality of remote control optical reception parts for performing a remote control. Then, the number of apparatus to be controlled is not limited to one, but a plurality of apparatus of the same application may exist, and a plurality of apparatus of different applications may also exist. However, it is necessary to set different contents to the remote control code and the address code.

As described above, according to the remote control signal reception device of the present invention, each of the remote control signals received by a plurality of reception parts is decoded by a decoder to create a decode signal, and on the basis of the identification information included in the reception signal, an effective signal showing the effectiveness of the decode signal is created, and the decode signal of the decoder outputting this effective signal is adopted, and therefore, even when noise is inputted in any one of the plurality of the reception parts, if at least one normal remote control signal is received, the processing by the above-described remote control signal is possible, and it becomes possible to surely control the remote control apparatus from a remote place.

Although the invention has been describes, with respect to specific embodiment for complete and clear disclosure, the appended claims are not to be thus limited but are to be construed as embodying all modification and alternative constructions that may be occurred to one skilled in the art which fairly fall within the basic teaching herein set forth.

What is claimed is:

1. A remote control signal reception device in which a remote control signal transmitted from a remote controller is received by one of a plurality of reception parts, and on the basis of a result made by decoding the received remote control signal, a remote control apparatus is controlled, comprising:

a plurality of decoders connected to one corresponding reception part of said plurality of reception parts and decoding said remote control signal to create a decode signal and creating an effective signal indicating effectiveness of said remote control signal on the basis of identification information included in said remote control signal; and a decoder selection part for outputting said decode signal on the basis of input of said effective signal when said decode signal is inputted, wherein said plurality of decoders comprise:

a plurality of decoder circuits for decoding said remote control signal to output said decode signal;

a plurality of extraction parts for extracting said identification information; and a plurality of decode judgment parts for creating said effective signal on the basis of collation between said identification information extracted by said plurality of extraction parts and previously registered registration identification information.

2. A remote control signal reception device in which a remote control signal transmitted from a remote controller is received by one of a plurality of reception parts, and on the basis of a result made by decoding the received remote control signal, a remote control apparatus is controlled, comprising:

a plurality of decoders connected to one corresponding reception part of said plurality of reception parts and decoding said remote control signal to create a decode signal and creating an effective signal indicating effectiveness of said remote control signal on the basis of identification information included in said remote control signal; and a decoder selection part for outputting said decode signal on the basis of input of said effective signal when said decode signal is inputted, wherein said decoder selection part comprises:

a plurality of AND circuits corresponding to said plurality of decoders and inputting said decode signal and said effective signal and outputting said decode signal; and an OR circuit for inputting and outputting said decode signal outputted from at least one of said plurality of AND circuits.

3. The remote control signal reception device in which a remote control signal transmitted from a remote controller is received by one of a plurality of reception parts, and on the basis of a result made by decoding the received remote control signal, a remote control apparatus is controlled, comprising:

a plurality of decoders connected to one corresponding reception part of said plurality of reception parts and decoding said remote control signal to create a decode signal and creating an effective signal indicating effectiveness of said remote control signal on the basis of identification information included in said remote control signal; and a decoder selection part for outputting said decode signal on the basis of input of said effective signal when said decode signal is inputted, wherein said decoder selection part comprises:

a plurality of AND circuits corresponding to said plurality of decoders and inputting said decode signal and said effective signal and outputting said decode signal; and an OR circuit for inputting and outputting said decode signal outputted from at least one of said plurality of AND circuits, wherein said plurality of decoder circuits have a priority based on priorities set to said plurality of reception parts, and one decoder circuit among said plurality of decoder circuits makes an AND circuit among said plurality of AND circuits corresponding to another decoder circuit whose priority is lower than that of said one decoder circuit be in the impassable state, when said effective signal is outputted.

4. The remote control signal reception device according to claim 3, wherein said remote control apparatus is a projection type display device.

5. A remote control signal reception device for receiving a remote control signal transmitted from a remote controller, comprising:

a plurality of reception parts, one of said reception parts receiving said remote control signal;

a plurality of decoders connected to a corresponding one of said plural reception parts for decoding said remote control signal to create a decode signal, each said plural decoders having a judgment part for differentiating between said remote control signal and a non-remote control signal; and a decoder selection part for outputting said decode signal.

6. The remote control signal reception device as claimed in claim 5, wherein each said plural decoders further comprises an address code extraction part.

7. The remote control signal reception device as claimed in claim 6, wherein said address code extraction part extracts an address code from said remote control signal and said non-remote control signal and said judgment part compares said address code from said remote control signal and said address code from said non-remote control signal to a previously registered address code.

8. The remote control signal reception device as claimed in claim 5, wherein said remote control signal is an infrared ray signal and said non-remote control signal is an electromagnetic wave.

9. A remote control signal reception device for receiving a remote control signal transmitted from a remote controller, comprising:

a plurality of reception parts, one of said reception parts receiving said remote control signal;

a plurality of decoder circuits connected to a corresponding one of said plural reception parts for decoding said remote control signal to create a decode signal and an effective signal indicating effectiveness of said remote control signal, each said plural decoder circuits having a priority based on priorities set to said plural reception parts, so that one of said plural decoder circuits makes another one of said plural decoder circuit having a priority lower than said one of said plural decoder circuits be in an impassable state, when said effective signal is outputted; and a decoder selection part for outputting said decode signal to control a remote control apparatus.

10. The remote control signal reception device as claimed in claim 9, wherein said remote control apparatus is a projection display device.

* * * * *